US005844378A

United States Patent [19]

LoCascio et al.

[11] Patent Number: 5,844,378

[45] Date of Patent: Dec. 1, 1998

[54] HIGH SIDE DRIVER TECHNIQUE FOR MINIATURE COLD CATHODE FLUORESCENT LAMP SYSTEM

[76] Inventors: James J. LoCascio, 6881 Hampton Dr., San Jose, Calif. 95120; Mehmet Nalbant, 2092 Concourse Dr., San Jose, Calif. 95131

[21] Appl. No.: 377,957

[22] Filed: Jan. 25, 1995

[51] Int. Cl.[6] ..... G05F 1/00

[52] U.S. Cl. ..... 315/307; 315/224; 315/306; 315/127; 363/25

[58] Field of Search ..... 315/307, 306, 315/291, 276, 239, 244, 224, 219, 209 R, 177, 127, 206; 363/25, 235

[56] References Cited

U.S. PATENT DOCUMENTS

| | | | |
|---|---|---|---|
| 2,483,815 | 10/1949 | Easton | 175/356 |
| 2,967,267 | 1/1961 | Steinman et al. | 317/101 |
| 3,292,579 | 12/1966 | Buchman | 119/5 |

(List continued on next page.)

FOREIGN PATENT DOCUMENTS

| | | |
|---|---|---|
| 0 059 064 | 9/1982 | European Pat. Off. . |
| 0 178 852 | 4/1986 | European Pat. Off. . |
| 32 33 655 A1 | 5/1983 | Germany . |
| 34 32 266 A1 | 3/1985 | Germany . |
| 9201334 | 1/1992 | WIPO . |

OTHER PUBLICATIONS

Micro Linear, "Advance Information ML–4830 Electronic Ballast Contoller", Jun. 1992.

Micro Linear, "Advance Information ML–4830 Electronic Ballast Controller", Jul. 1992.

J. Williams, "Techniques for 92% Efficient LCD Illumination" *Linear Technology Application Note 55,* pp. AN55–1–43, Aug. 1993.

Micro Linear, "ML4874 LCD Backlight Lamp Driver," pp. 1–6, Apr. 1994.

Micro Linear, "ML4876 LCD Backlight Lamp Driver with Constrast," pp. 1–6, Apr. 1994.

U. Mader, et al., Micro Linear, "Application Note 26—Power Conversion Efficiencies for Miniature Fluorescent Lamp," pp. 1–6, Feb. 1994.

K. Kit Sum, et al., Micro Linear, "Application Note 32—Theory and Application of the ML4874 and ML4876 LCD Backlight Controller ICs," pp. 1–12, Jun. 1994.

J. J. LoCascio and U. H. Mader, "A New Control Technique Uses 25% Less Power To Drive Miniature Cold Cathode Fluorescent Lamps," *Electronic Ballast,* pp. 60–69, Apr. 1994.

(List continued on next page.)

*Primary Examiner*—Robert Pascal
*Assistant Examiner*—Haissa Philogene
*Attorney, Agent, or Firm*—Haverstock & Associates

[57] ABSTRACT

A circuit for supplying power to a fluorescent lamp comprising a buck regulator with a high side drive. A dc battery is coupled to a drain of a first transistor. A source of the first transistor is coupled to an inverter for powering the lamp. A first control signal is coupled to a primary winding of a transformer. A first terminal of a secondary winding of the transformer is coupled to the anode of a diode. The cathode of the diode is coupled to the gate of the first transistor. A second terminal of the secondary winding of the transformer is coupled to the source of first transistor. The first control signal is activated to bias the first transistor through the transformer by charging the gate to a voltage higher than the control voltage due to the transformer turns ratio. A diode is coupled to capture a charge on the gate. A second transistor is coupled to the gate of the first transistor to drain the captured charge to ground, turning off the first transistor when a second control signal is activated. A third transistor is coupled to ground the source of the first transistor when a third control signal is activated. The lamp brightness is regulated by varying a duty cycle of the buck regulator synchronized to the inverter. The first transistor is turned on when two inverter transistors change state. After a time determined by a lamp current feedback signal, the first transistor is turned off and the third transistor is turned on. The third transistor stays on until the inverter transistors change state again, then the first transistor is turned on again.

20 Claims, 4 Drawing Sheets

U.S. PATENT DOCUMENTS

| | | | |
|---|---|---|---|
| 3,549,990 | 12/1970 | Hochheiser | 323/44 |
| 3,611,021 | 10/1971 | Wallace | 315/239 |
| 3,758,823 | 9/1973 | Jett et al. | 315/219 |
| 3,772,625 | 11/1973 | Raupach | 336/94 |
| 3,778,677 | 12/1973 | Kriege | 315/219 |
| 3,840,795 | 10/1974 | Roszyk et al. | 320/2 |
| 3,921,005 | 11/1975 | Watous | 307/64 |
| 3,953,768 | 4/1976 | Meredith et al. | 317/31 |
| 4,030,058 | 6/1977 | Riffe et al. | 336/92 |
| 4,031,449 | 6/1977 | Trombly | 320/2 |
| 4,038,625 | 7/1977 | Tompkins et al. | 336/83 |
| 4,063,108 | 12/1977 | Klett et al. | 307/64 |
| 4,144,462 | 3/1979 | Sieron et al. | 307/66 |
| 4,146,857 | 3/1979 | Schleupen | 336/61 |
| 4,172,981 | 10/1979 | Smith | 307/66 |
| 4,207,498 | 6/1980 | Spira et al. | 315/97 |
| 4,210,846 | 7/1980 | Capewell et al. | 315/121 |
| 4,251,752 | 2/1981 | Stolz | 315/206 |
| 4,260,943 | 4/1981 | Zaderej et al. | 320/21 |
| 4,277,726 | 7/1981 | Burke | 315/98 |
| 4,277,728 | 7/1981 | Stevens | 315/307 |
| 4,297,614 | 10/1981 | Chandler | 315/86 |
| 4,303,902 | 12/1981 | Lesster et al. | 336/83 |
| 4,318,608 | 3/1982 | Payne | 355/3 CH |
| 4,414,493 | 11/1983 | Henrich | 315/308 |
| 4,441,053 | 4/1984 | Daspit | 315/206 |
| 4,441,054 | 4/1984 | Bay | 315/219 |
| 4,453,109 | 6/1984 | Stupp et al. | 315/219 |
| 4,486,689 | 12/1984 | Davis et al. | 315/92 |
| 4,495,446 | 1/1985 | Brown et al. | 315/206 |
| 4,496,896 | 1/1985 | Melocik et al. | 320/2 |
| 4,498,031 | 2/1985 | Stupp et al. | 315/307 |
| 4,523,131 | 6/1985 | Zansky | 315/307 |
| 4,528,482 | 7/1985 | Merlo | 315/291 |
| 4,543,556 | 9/1985 | Taylor et al. | 336/210 |
| 4,572,988 | 2/1986 | Handler et al. | 315/209 R |
| 4,585,974 | 4/1986 | Stupp et al. | 315/307 |
| 4,604,552 | 8/1986 | Alley et al. | 315/176 |
| 4,612,479 | 9/1986 | Zansky | 315/194 |
| 4,654,573 | 3/1987 | Rough et al. | 320/2 |
| 4,686,427 | 8/1987 | Burke | 315/219 |
| 4,698,554 | 10/1987 | Stupp et al. | 315/307 |
| 4,700,113 | 10/1987 | Stupp et al. | 315/224 |
| 4,704,563 | 11/1987 | Hussey | 315/307 |
| 4,717,863 | 1/1988 | Zeiler | 315/307 |
| 4,723,098 | 2/1988 | Grubbs | 315/306 |
| 4,739,277 | 4/1988 | Anderson | 315/260 |
| 4,763,239 | 8/1988 | Ball | 363/98 |
| 4,800,328 | 1/1989 | Bolger et al. | 320/2 |
| 4,874,989 | 10/1989 | Nilssen | 315/151 |
| 4,893,059 | 1/1990 | Nilssen | 315/127 |
| 4,896,077 | 1/1990 | Dodd et al. | 315/289 |
| 4,920,299 | 4/1990 | Presz et al. | 315/98 |
| 4,935,669 | 6/1990 | Nilssen | 315/105 |
| 4,942,352 | 7/1990 | Sano | 320/2 |
| 4,952,849 | 8/1990 | Fellows et al. | 315/307 |
| 5,015,919 | 5/1991 | Vila-Masot et al. | 315/86 |
| 5,048,033 | 9/1991 | Donahue et al. | 372/38 |
| 5,049,790 | 9/1991 | Herfurth et al. | 315/291 |
| 5,111,118 | 5/1992 | Fellows et al. | 315/307 |
| 5,177,408 | 1/1993 | Marques | 315/291 |
| 5,202,608 | 4/1993 | Johnson | 315/86 |
| 5,214,352 | 5/1993 | Love | 315/86 |
| 5,216,402 | 6/1993 | Carosa | 336/66 |
| 5,237,242 | 8/1993 | Takahashi et al. | 315/123 |
| 5,264,776 | 11/1993 | Hulsey | 320/2 |
| 5,363,020 | 11/1994 | Chen et al. | 315/209 R |
| 5,367,223 | 11/1994 | Eccher | 315/97 |
| 5,367,224 | 11/1994 | Pacholok | 315/219 |
| 5,367,242 | 11/1994 | Hulman | 320/2 |
| 5,384,516 | 1/1995 | Kawabata et al. | 315/160 |
| 5,408,162 | 4/1995 | Williams | 315/224 |
| 5,615,093 | 3/1997 | Nalbant | 315/307 X |

OTHER PUBLICATIONS

M. Jordan and J.A. O'Connor, "Resonant Fluoresent Lamp Converter Provides Efficient and Compact Solution," *IEEE,* pp. 424–431, 1993 no month.

Maxim Integrated Products, "CCFT Backlight and LCD Contrast Controllers—MAX753/MAX754," pp. 1–12, Feb. 1994.

K. Kit Sum, Micro Linear, "ML4874 Evaluation Kit User's Guide—LCD Backlight Lamp Driver," pp. 1–5, Apr. 1994.

Micro Linear, "ML4864 Evaluation User's Guide—LCD Backlight Lamp Driver with Contrast Control," pp. 1–4, Jan. 1994.

Micro Linear, "ML4864 LCD Backlight Lamp Driver with Contrast," pp. 1–6, Nov. 1993.

HIGH SIDE DRIVER TECHNIQUE FOR MINIATURE COLD CATHODE FLUORESCENT LAMP SYSTEM

FIELD OF THE INVENTION

This invention relates to circuits for supplying power to fluorescent lamps. More specifically, this invention relates to circuits for supplying power to miniature cold cathode fluorescent lamps having buck regulators with high side drivers.

BACKGROUND OF THE INVENTION

Fluorescent lamps have "negative resistance." This means that the operating voltage decreases as power dissipation in the lamp increases. Therefore, circuits for supplying power to fluorescent lamps require a controllable alternating current power supply to maintain operating stability of the circuit and to have an ability to vary the lamp brightness. In battery powered applications, such as when a fluorescent lamp is used as a backlight for a liquid crystal display screen in a lap top computer, only dc power is available. A circuit for supplying a controllable alternating current from a dc supply is a buck regulator having a controllable duty cycle coupled to an inverter circuit. However, the dc battery supply may be 20–30 volts, whereas the voltage available to control the duty cycle of the buck regulator may be only a 5 volt logic level. What is needed is a circuit for translating the reference potential of a 5V logic level signal from ground to the reference potential of a floating switch.

SUMMARY OF THE INVENTION

The invention is a circuit for supplying power to a fluorescent lamp comprising a buck converter with a main power switch requiring a high side drive. The circuit comprises a first MOSFET transistor as a main power switch. A dc battery supply of 20–30 volts is coupled to a drain of the first transistor. A source of the first transistor is coupled to an inductor. The inductor is coupled to an inverter for powering the fluorescent lamp. A first control signal is coupled to a primary winding of a transformer. A first terminal of a secondary winding of the transformer is coupled to the anode of a diode. The cathode of the diode is coupled to the gate of the first transistor. A second terminal of the secondary winding of the transformer is coupled to the source of first transistor. The first control signal is activated by a controller to bias the gate of the first transistor through the transformer. This charges the gate to a voltage level that is higher than the control voltage level due to the transformer turns ratio. The polarity of the transformer is such that the transistor is supplied with a voltage of the appropriate polarity for biasing the gate of the first transistor. A diode is coupled to capture a charge on the gate of the first transistor to maintain the gate bias. A drain of a second transistor is coupled to the gate of the first transistor. A source of the second transistor is coupled to a ground node. A gate of the second transistor is coupled to a second control signal. The second control signal is activated to bias the gate of the second transistor, which drains the charge captured on the gate of the first transistor to the ground node, turning off the first transistor. A drain of a third transistor is coupled to the source of the first transistor. A source of the third transistor is coupled to ground. A gate of third transistor is coupled to a third control signal.

The fluorescent lamp brightness is regulated by the controller by varying a duty cycle of the buck regulator. The buck regulator is synchronized to a resonant tank of the inverter, and the controller will turn the first transistor on when two inverter transistors change state. After a time determined by a lamp current feedback signal, the first transistor is turned off and the source of the first transistor third transistor stays on until the inverter transistors change state again, then the first transistor is turned on again. In this way, the duty cycle of the buck converter is controlled.

DETAILED DESCRIPTION OF THE PREFERRED EMBODIMENT

Figure 1:
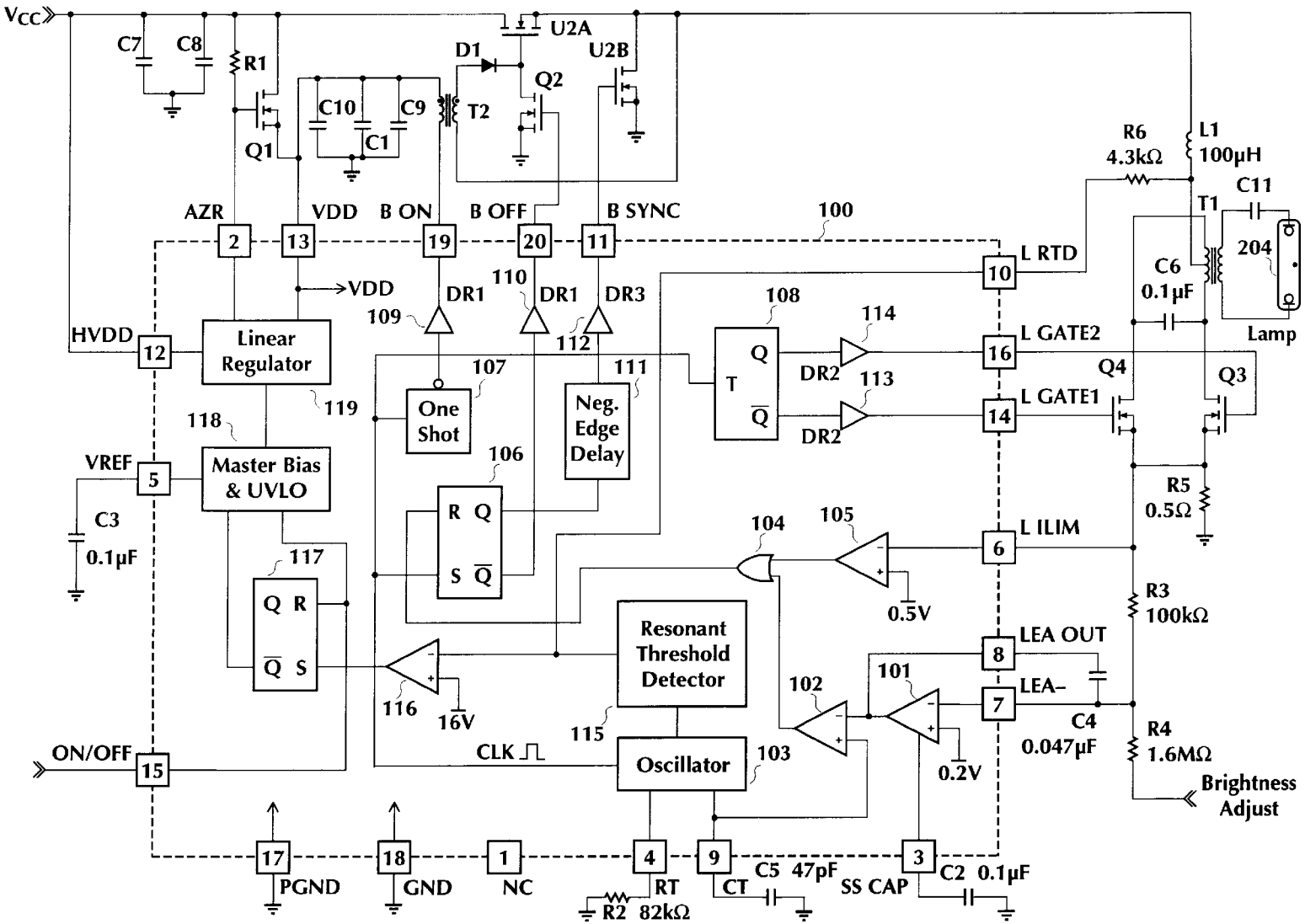
FIG. 1 shows a schematic diagram of the preferred embodiment of the present invention.

Referring to FIG. 1, a liquid crystal display (LCD) backlight integrated circuit controller 100 is shown along with external circuits that are needed to illuminate a fluorescent lamp. The integrated circuit controller 100 includes the portion of the diagram enclosed by the dotted lines. The controller 100, shown in FIG. 1 and bounded by the dotted lines, is an LCD Backlight Lamp Driver, part number ML4874, manufactured by Micro Linear Corporation, which is located at 2092 Concourse Drive, in San Jose, Calif. Micro Linear Corporation also manufactures an LCD Backlight Lamp Driver with Contrast, part number ML4876 and an LCD Backlight Lamp Driver w/Contrast Control, part number ML4864, which are similar to part number ML4874, except they have circuits to control an LCD contrast level. The controller 100 has pins 1–20 that interface with the external circuits.

Referring to portions of the diagram outside the dotted lines, a voltage source node Vcc is coupled to pin 12, to a first terminal of a capacitor C7, to a first terminal of a capacitor C8, to a first terminal of a resistor R1, to a drain of an n-channel MOSFET Q1, and to the drain of an n-channel MOSFET U2-A. A second terminal of the capacitor C7 is coupled to ground. A second terminal of the capacitor C8 is coupled to ground. A second terminal of the resistor R1 is coupled to a gate of the MOSFET Q1 and to pin 2. A source of the MOSFET Q1 is coupled to pin 13, to a first terminal of a capacitor C10, to a first terminal of a capacitor C1, to a first terminal of a capacitor C9 and to a first terminal of a primary winding of a transformer T2. A second terminal of the capacitor C10, a second terminal of the capacitor C1, and a second terminal of the capacitor C9 are coupled to ground. A second terminal of the primary winding of the transformer T2 is coupled to pin 19. A first terminal of a secondary winding of the transformer T2 is coupled to an anode of a diode D1. A second terminal of the secondary winding of the transformer T2 is coupled to a source of the MOSFET U2-A. The transformer T2 has voltage polarities of the primary and secondary windings that are the same, as shown by the dot conventions in FIG. 1. A cathode of the diode D1 is coupled to a gate of the MOSFET U2-A and to a drain of an n-channel MOSFET Q2. A source of the MOSFET Q2 is coupled to ground. A gate of the MOSFET Q2 is coupled to pin 20. A drain of an n-channel MOSFET U2-B is coupled to the source of the MOSFET U2-A. A source of the MOSFET U2-B is coupled to ground. A gate of the MOSFET U2-B is coupled to pin 11.

A first terminal of an inductor L1 is coupled to the source of the MOSFET U2-A. A second terminal of the inductor L1 is coupled to a first terminal of a resistor R6 and to a center tap of a primary winding of a transformer T1. A second terminal of the resistor R6 is coupled to pin 10. A first terminal of a secondary winding of the transformer T1 is coupled to a first terminal of a fluorescent lamp 204. A second terminal of the secondary winding of the transformer T1 is coupled to a second terminal of the fluorescent lamp 204. A capacitor C11 for maintaining control stability in a lamp current feedback loop may be coupled in series with the fluorescent lamp 204, but is not always required. Further, it is known in the art that more than one fluorescent lamp may be coupled in parallel. A first terminal of the primary winding of the transformer T1 is coupled to a first terminal of a capacitor C6 and to a drain of an n-channel MOSFET Q3. A gate of the MOSFET Q3 is coupled to pin 16. A source of the MOSFET Q3 is coupled to a first terminal of a resistor R5. A second terminal of the resistor R5 is coupled to ground. A second terminal of the primary winding of the transformer T1 is coupled to a second terminal of the capacitor C6 and to a drain of an n-channel MOSFET Q4. A gate of the MOSFET Q4 is coupled to pin 14. A source of the MOSFET Q4 is coupled to the first terminal of the resistor R5. The first terminal of the resistor R5 is coupled to pin 6 and to a first terminal of a resistor R3. A second terminal of the resistor R3 is coupled to a first terminal of a resistor R4, to a first terminal of a capacitor C4 and to pin 7. A second terminal of the resistor R4 is coupled to a voltage level BRIGHTNESS ADJUST to control the lamp brightness level. A second terminal of the capacitor C4 is coupled to pin 8. A first terminal of a capacitor C2 is coupled to pin 3. A second terminal of the capacitor C2 is coupled to ground. A first terminal of a capacitor C5 is coupled to pin 9. A second terminal of the capacitor C5 is coupled to ground. A first terminal of a resistor R2 is coupled to pin 4. A second terminal of the resistor R2 is coupled to ground. Pin 1 is a spare. Pin 18 and Pin 17 are coupled to ground. Pin 15 is coupled to a voltage level, ON/OFF. A first terminal of a capacitor C3 is coupled to Pin 5. A second terminal of the capacitor C3 is coupled to ground. Alternately, Q3 and Q4 could be bipolar transistors.

Referring to optional components of FIG. 1, a first terminal of a resistor R50 is coupled to pin 10. A second terminal of R50 is coupled to ground.

Referring to portions of the diagram comprising the controller 100, which are inside the dotted lines, pin 7 is coupled to an inverting input of a amplifier 101. A non-inverting input of the amplifier 101 is coupled to a reference voltage level of 0.2 volts. A terminal of the amplifier 101 is coupled to pin 3 to couple the optional soft start capacitor C2 to the amplifier 101. An output of the amplifier 101 is coupled to pin 8 and to an inverting input of a comparator 102. Pin 9 is coupled to a first terminal of an oscillator 103 to the oscillation frequency with the timing capacitor C5. An output of the comparator 102 is coupled to a first input to an OR gate 104. An inverting input to a comparator 105 is coupled to pin 6. A non-inverting input to the comparator 105 is coupled to a voltage reference level of 0.5 volts. An output of the comparator 105 is coupled to a second input to the OR gate 104. An output of the OR gate 104 is coupled to a RESET terminal of a flip-flop 106. A second terminal of the oscillator 103 is coupled to pin 4 to set the oscillation frequency of the oscillator 103 with the timing resistor R2. A third terminal of the oscillator 103 is coupled to deliver a clock signal to a SET terminal of the flip-flop 106, to a first terminal of a one-shot circuit 107 and to a TOGGLE input to a flip-flop 108. A second terminal of the one-shot circuit 107 is coupled to an input terminal to a buffer 109. An output terminal of the buffer 109 is coupled to pin 19. A Q-not output of the flip-flop 106 is coupled to an input to a buffer 110. An output of the buffer 110 is coupled to pin 20. A Q output of the flip-flop 106 is coupled to an input of a negative edge delay 111. An output of the negative edge delay 111 is coupled to an input to a buffer 112. An output of the buffer 112 is coupled to pin 11. A Q-not output of the flip-flop 108 is coupled to an input to a buffer 113. An output of the buffer 113 is coupled to pin 14. A Q output of the flip-flop 108 is coupled to an input to a buffer 114. An output of the buffer 114 is coupled to pin 16. A forth terminal of the oscillator 103 is coupled to receive a signal from a first terminal of a resonant threshold detector 115 to synchronize the oscillator 103. Pin 10 is coupled to deliver a zero voltage level signal to a second terminal of the resonant threshold detector 115 and to an inverting input to an error amplifier 116. A non-inverting input to the amplifier 116 is coupled to a reference voltage level of 16 volts. An output of the amplifier 116 is coupled to a SET input to a flip-flop 117. A Q-not output of the flip-flop 117 is coupled to deliver a control signal to a first terminal of a master bias & uvlo 118 to shut down power to the fluorescent lamp if a voltage at pin 10 exceeds 16 volts. Pin 15 is coupled to a second terminal of the master bias & uvlo 118 and to a RESET input to the flip-flop 117 to restore power to the fluorescent lamp after a shut down by toggling the voltage level at pin 15. A third terminal of the master bias & uvlo 118 is coupled to deliver a reference voltage level to pin 5. A forth terminal of the master bias & uvlo 118 is coupled to receive power from a first terminal of a linear regulator 119. A second terminal of the linear regulator 119 is coupled to receive power from pin 12. A third terminal of the linear regulator 119 is coupled to pin 2. Internal to the linear regulator 119, the third terminal of the linear regulator 119 is coupled to a cathode of a Zener diode DAZR (not shown). The anode of the diode DAZR is coupled to ground. A forth terminal of the linear regulator 119 is coupled to pin 13 and coupled to provide a supply voltage to the circuits within the dotted lines.

An invertor comprises T1, C6, lamp 204, Q3, Q4 and R5. The inverter is known in the art as comprising a current fed Royer-type inverter. A resonant tank circuit comprises C6 and the primary winding of the transformer T1. Q3 and Q4 comprise a push-pull transistor pair. The controller 100 alternately turns Q3 and Q4 on. This draws current from the resonant tank circuit which in turn generates a voltage across the secondary winding of T1 to power the lamp. When a voltage at the center tap of the transformer reaches a zero voltage level, the controller turns on either Q3 or Q4 and turns off the other. Because the controller alternates only at zero voltage levels, the tank circuit is driven at its resonant frequency. An internal oscillator 103 provides the switching signals for start-up. The current through R5 is substantially proportional to the current through the lamp. The current through the lamp is substantially sinusoidal. The current drawn by Q3 and Q4 generates a voltage at Pin 6 which is sensed and monitored by the controller so the lamp current can be monitored for an over current condition. The voltage at the node that comprises the source of Q3, the source of Q4 and the first terminal of R5 is coupled to the inverting input of the amplifier 101 through R3. The output of the amplifier 101 is coupled to control the duty cycle of the buck regulator. The inverter does not regulate the lamp brightness by varying the switching frequency because the inverter drives the lamp at the resonant frequency of the tank circuit.

A buck regulator has power processing components which are: a primary switch U2-A, a synchronous rectifier U2-B, and a buck inductor L1. The primary switch, U2-A, has a high side drive circuit which comprises T2, D1, and Q2. The buck regulator provides a dc current signal to the inverter circuit through L1. The fluorescent lamp brightness is regulated by the controller by varying a duty cycle of the buck regulator. The buck regulator is synchronized to the inverter, and will turn U2-A on when the inverter transistors, Q3 and Q4, change state. U2-A and U2-B have a high current capacity, and in the preferred embodiment, are manufactured as a Dual 20v, 0.10 Ohm, n-channel, MOSFET transistor manufactured by Motorola, under part number MMDF2N02. After a time determined by a lamp current feedback signal, U2-A is turned off and U2-B is turned on. U2-B stays on until the inverter transistors, Q3 and Q4, change state and U2-A is turned on again. In this way, the controller controls the duty cycle of the buck regulator. U2-B may be replaced with a rectifier, but the efficiency of the system may suffer.

The controller drives the gate of U2-A through the miniature pulse transformer T2. T2 can be made with a ferrite bead with one turn on the primary winding and two turns on the secondary winding. Alternatively, T2 may be a low cost, surface mount transformer, such as part number CP-4LBM, which is available from Sumida, 637 East Golf Road, Suite 209, Arlington Heights, Ill., 60005. When a controller output, a signal B-ON, is activated, the voltage generated at the secondary winding of T2 is greater than the voltage level of the signal B-ON because of the transformer. B-ON is a logic level voltage of approximately 5 volts. When the signal B-ON is activated, the diode D1 becomes forward biased so that the gate of U2-A becomes charged to a higher potential than B-ON (to approximately 10 volts). When B-ON is deactivated, the diode D1 then becomes reverse biased which captures the charge on the gate of U2-A and keeps U2-A turned on. When the signal B-OFF is activated, the gate of Q2, a small signal device, is driven high by the controller. This turns Q2 on and causes the charge captured on the gate of U2-A to drain off to ground through Q2, turning U2-A off.

Figure 2:
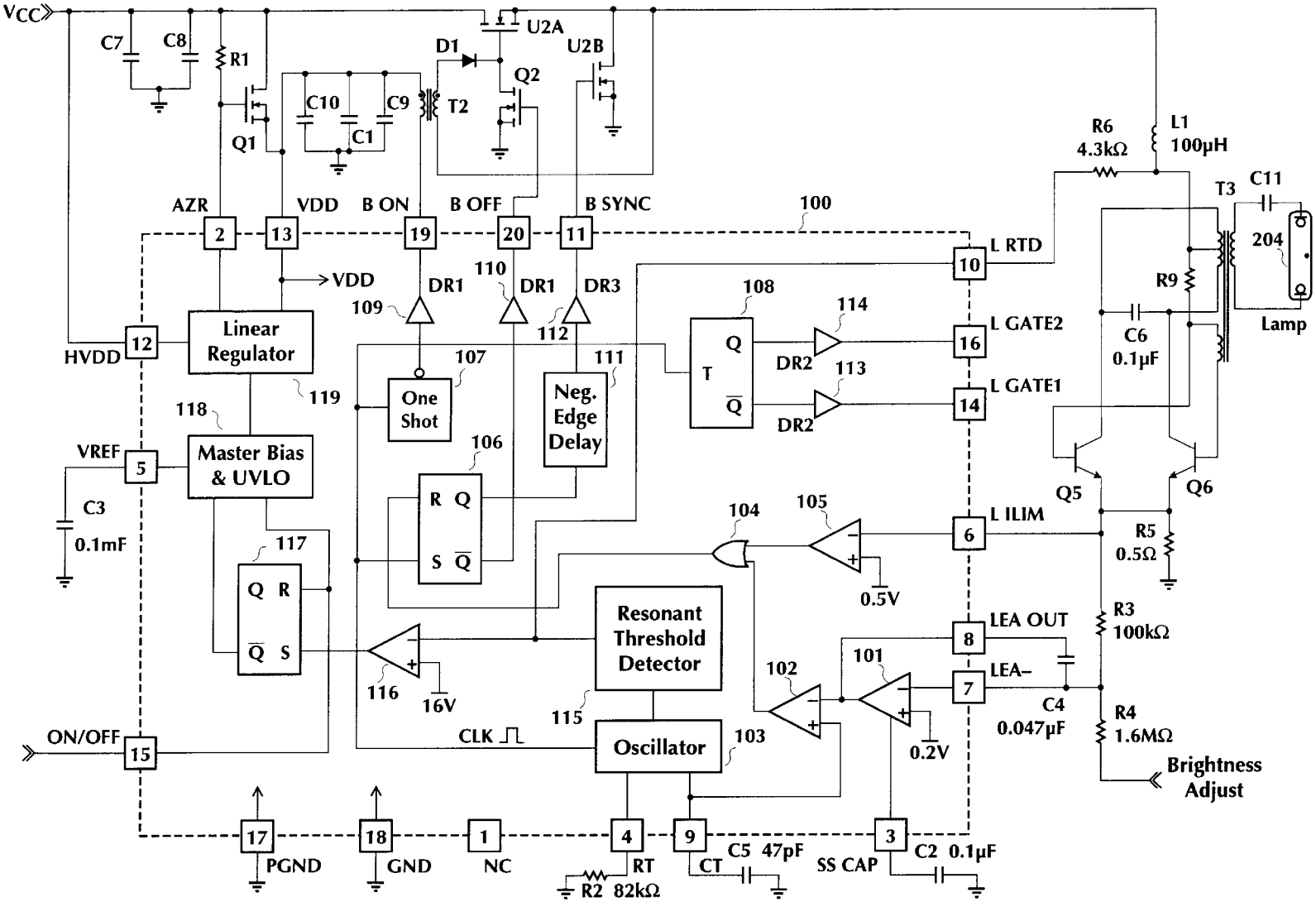
FIG. 2 shows a schematic diagram of a first alternate embodiment of the present invention.

Referring to FIG. 2, a schematic diagram of a first alternate embodiment of the present invention is shown. The circuit shown in FIG. 2 is substantially the same as the circuit shown in FIG. 1, as discussed above, except for the differences discussed below. The primary difference, from which the other differences arise, is that the circuit shown in FIG. 2 drives the push-pull transistor pair with an additional winding of a transformer T3 whereas the circuit shown in FIG. 1 drives the push-pull transistor pair with control signals from the controller 100. A first terminal of an inductor L1 is coupled to the source of the MOSFET U2-A. A second terminal of the inductor L1 is coupled to a first terminal of a resistor R6 and to a center tap of a first primary winding of a transformer T3. The second terminal of the inductor L1 is also coupled to a first terminal of a resistor R9. A second terminal of the resistor R6 is coupled to pin 10. A first terminal of the first primary winding of the transformer T3 is coupled to a first terminal of a capacitor C6 and to a collector of an npn bipolar transistor Q5. A second terminal of the first primary winding of the transformer T3 is coupled to a second terminal of the capacitor C6 and to a collector of an npn bipolar transistor Q6. A first terminal of a secondary winding of T3 is coupled to a first terminal of a fluorescent lamp 204. A second terminal of the secondary winding of T3 is coupled to a second terminal of a fluorescent lamp 204. A capacitor C11 for maintaining control stability in a lamp current feedback loop may be coupled in series with the fluorescent lamp 204, but is not always required. A second terminal of the resistor R9 is coupled a first terminal of a second primary winding of the transformer T3 and to a base of the transistor Q5. A second terminal of the second primary winding of T3 is coupled to a base of the transistor Q6. An emitter of the transistor Q5 and an emitter of the transistor Q6 are coupled to a first terminal of a resistor R5. The transistors Q5 and Q6 comprise a push-pull transistor pair. The first terminal of the resistor R5 is also coupled to pin 6 and to a first terminal of a resistor R3. A second terminal of the resistor R5 is coupled to the ground node. A second terminal of the resistor R3 is coupled to a first terminal of a resistor R4 and to a first terminal of a capacitor C4 and to pin 7. A second terminal of the capacitor C4 is coupled to pin 8. A second terminal of the resistor R4 is coupled to a voltage level BRIGHTNESS ADJUST. The voltage level at the center tap of T3 serves to bias the base of Q5 and the base of Q6 through the second primary winding of T3 so that the resultant operation of the inverter circuit shown in FIG. 2 is substantially the same as the operation of the inverter circuit shown in FIG. 1. Alternately, Q5 and Q6 could be MOSFET transistors which are driven by the second primary winding of T3.

Figure 3:
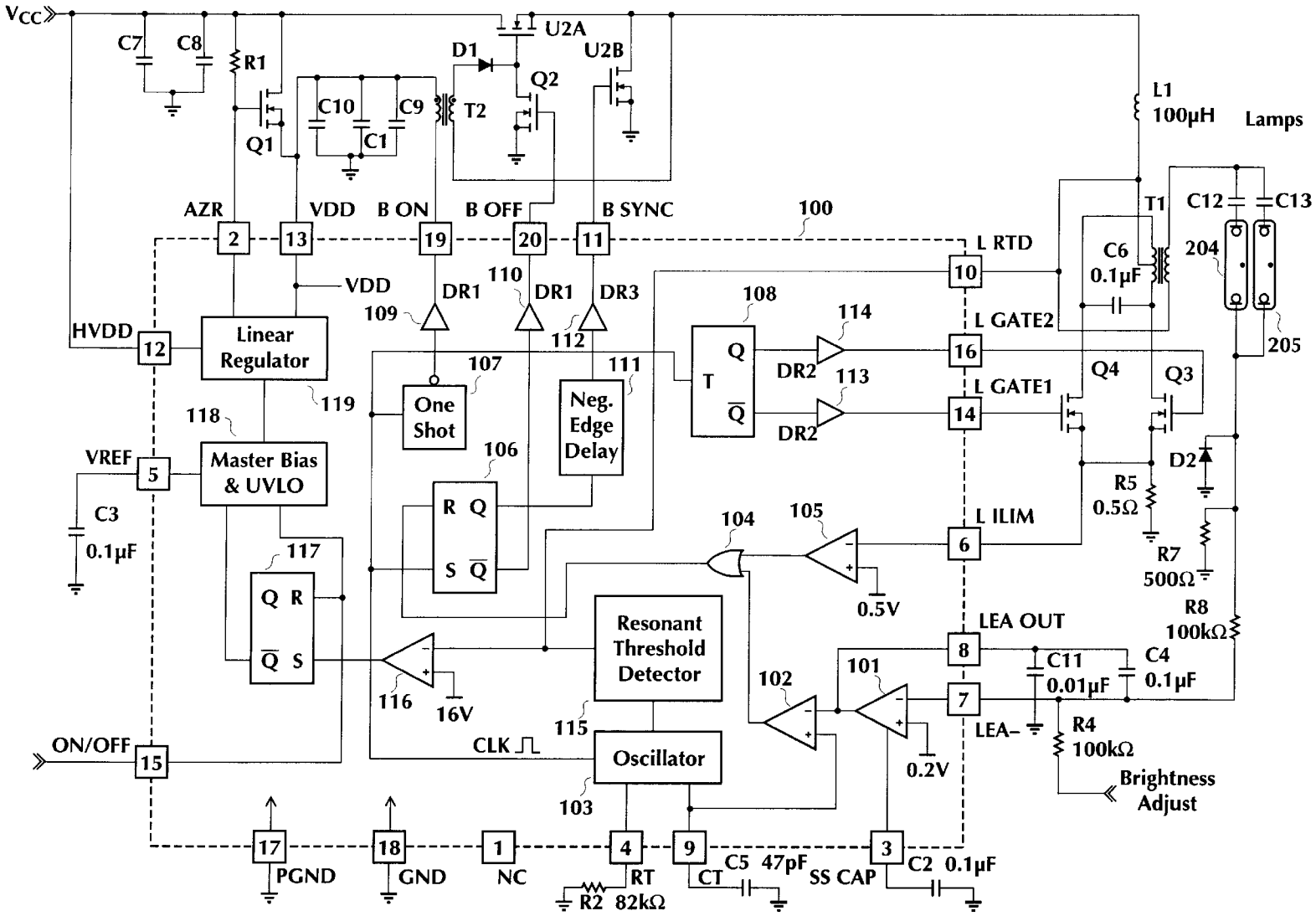
FIG. 3 shows a schematic diagram of a second alternate embodiment of the present invention.

Referring to FIG. 3, a schematic diagram of a second alternate embodiment of the present invention is shown. The circuit shown in FIG. 3 is substantially the same as the circuit shown in FIG. 1, as discussed above, except for the differences discussed below. The primary difference, from which the other differences arise, is that the circuit shown in FIG. 3 senses a current representative of the lamp current on the secondary side of the transformer T1 whereas the circuit shown in FIG. 1 senses a current representative of the lamp current on the primary side of T1. A first terminal of an inductor L1 is coupled to the source of the MOSFET U2-A. A second terminal of the inductor L1 is coupled to pin 10 and to a center tap of a primary winding of a transformer T1 and to a first terminal of a secondary winding of the transformer T1. A first terminal of the primary winding of the transformer T1 is coupled to a first terminal of a capacitor C6 and to a drain of an n-channel MOSFET Q3. A second terminal of the primary winding of the transformer T1 is coupled to a second terminal of the capacitor C6 and to a drain of an n-channel MOSFET Q4. A gate of the MOSFET Q3 is coupled to pin 16. A source of the MOSFET Q3 is coupled to a first terminal of a resistor R5. A gate of the MOSFET Q4 is coupled to pin 14. A source of the MOSFET Q4 is coupled to the first terminal of the resistor R5. The first terminal of the resistor R5 is coupled to pin 6. The second terminal of the resistor R5 is coupled to the ground node. A second terminal of the secondary winding of T1 is coupled to a first terminal of one fluorescent lamp 204. A second fluorescent lamp 205 can also be coupled in the circuit. When two or more fluorescent lamps are used, a ballast capacitor must be used for each such lamp. A capacitor C12 is coupled in series with the fluorescent lamp 204 and a capacitor C13 is coupled in series with the fluorescent lamp 205. A second terminal of the one fluorescent lamp 204 and the fluorescent lamp 205, if present, are each coupled to a cathode of a diode D2 and to a first terminal of a resistor R7 and to a first terminal of a resistor R8. An anode of the diode D2 is coupled to the ground node. A second terminal of the resistor R7 is coupled to the ground node. A second terminal of the resistor R8 is coupled to pin 7. A second terminal of the resistor R4 is coupled to a first terminal of a capacitor C4 and to pin 7. A second terminal of the capacitor C4 is coupled to pin 8 and to a first terminal of a capacitor C11. A second terminal of the capacitor C11 is coupled to the ground node. Alternately, Q3 and Q4 could be bipolar transistors.

Figure 4:
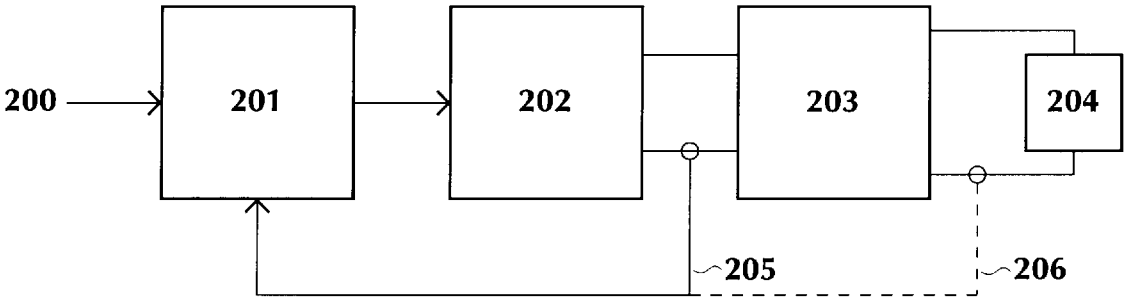
FIG. 4 shows a block diagram of a closed loop control system of the present invention.

Referring now to FIG. 4, a control loop of the present invention is shown. A reference signal 200 is supplied to a controller 201 to control a brightness level of the lamp 204. A feedback signal 205 is also supplied to the controller 201. Alternately, a feedback signal 206 is supplied to the controller 201. The feedback signal 205 corresponds to the primary side lamp current sensing shown in FIG. 1 whereas the feedback signal 206 corresponds to the secondary side lamp current sensing shown in FIG. 3. The controller 201 controls a duty cycle of a buck regulator 202 based on the reference signal 200 and a feedback signal 205 or 206. The buck regulator 202 supplies current to an inverter 203 which powers the lamp 204. A current in the lamp is sensed and fed back to the controller 201 through the feedback signal 205 or 206 that is representative of the current in the lamp.

Fluorescent lamps of the type contemplated for use with this invention have negative resistance under certain frequencies and voltage levels. This means that the operating voltage decreases as power dissipation in the lamp increases. Referring to FIG. 1, the lamp 204 is mounted in a lamp socket. The lamp socket is coupled to the circuit for supplying power to the lamp. When there is no lamp in the socket and the circuit for supplying power to the lamp is turned on, the output voltage in the lamp socket will tend to rise to a high level anticipating the start of an actual lamp. This condition is sensed by resistor R6 which is coupled to pin 10. The voltage level at pin 10 is applied to the inverting input to the amplifier 116. A 16 volt reference voltage is coupled to the non-inverting input of the amplifier 116. The output of the amplifier sets the latch 117. The output of the latch 117 signals the master bias & uvlo circuit 118 to shut down the linear regulator 119 and thereby disables the controller 100. Thus, when the voltage at pin 10 rises above 16 volts, the controller 100 will suppress the output voltage to the lamp socket by shutting down. The latch 117 can be reset and power restored to the controller 100 by toggling the logic level at pin 15, the ON/OFF input to the controller 100.

To accommodate different lamp types, sometimes it is desirable to have a voltage higher than 16 volts at the center tap of the transformer T1. In this event, the resistor R50 can be added between pin 10 and ground to form a voltage divider.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention. Specifically, it will be apparent that to one of ordinary skill in the art that the device of the present invention could be implemented in several different ways and the apparatus disclosed above is only illustrative of the preferred embodiment of the invention and is in no way a limitation. For example, it would be within the scope of the invention to vary the values of the various components, frequencies and voltage levels disclosed herein.

What is claimed is:

1. A circuit for supplying power to a fluorescent lamp comprising:

a. a transformer having a primary winding and a secondary winding for transforming a source power signal to a transformed power signal;

b. a power delivery circuit coupled to the secondary winding and to a fluorescent lamp for providing the transformed power signal from the secondary winding to the fluorescent lamp; and c. a power receiving circuit coupled to the primary winding and to a source voltage for delivering the source power signal to the primary winding, the power receiving circuit further comprising:

(1) a power converter having an active mode and an inactive mode for converting the source voltage to the source power signal;

(2) an enabling circuit coupled to control the power converter, wherein the enabling circuit includes a storage node for storing a voltage that is sufficient to maintain the power converter in the active mode; and (3) a sensing circuit, coupled to the power delivery circuit for sensing a current flowing through the fluorescent lamp for controlling a discharge circuit which discharges the storage node and couples the primary winding to ground, thereby changing the power converter to the inactive mode.

2. The circuit according to claim 1 wherein the power delivery circuit comprises an inverter circuit having a resonant tank for forming a resonant signal and wherein the enabling circuit changes the power converter to the active mode when the resonant signal reaches a zero voltage level.

3. The circuit according to claim 2 wherein the source power signal is substantially a square wave current signal having a controllable duty cycle wherein the duty cycle is controlled by the power converter alternately entering the active mode and the inactive mode.

4. A circuit for supplying power to a fluorescent lamp comprising:

a. a voltage source;

b. a MOSFET having a first drain, a first source, and a first gate, wherein the first drain is coupled to the voltage source and the first source is coupled to provide a buck current to a fluorescent lamp circuit;

c. means for charging the first gate to a voltage level;

d. means for capturing a charge on the first gate; and e. means for removing the charge from the first gate.

5. The circuit according to claim 4 wherein the means for charging comprises:

a. a controller for providing a first control signal; and b. a transformer having a primary winding and a secondary winding wherein the primary winding is coupled to receive the first control signal and wherein the secondary winding is coupled to the first gate whereby activation of the first control signal charges the first gate through the transformer.

6. The circuit according to claim 5 wherein the means for capturing the charge comprises a diode having a cathode and an anode wherein the cathode is coupled to the first gate and the anode is coupled to the secondary winding and further wherein the primary winding has a first terminal coupled to a control output and a second terminal coupled to a low impedance voltage and wherein the secondary winding has a third terminal coupled to the anode and a fourth terminal coupled to the first source.

7. The circuit according to claim 6 wherein the means for removing the charge comprises a second MOSFET having a second drain, a second source, and a second gate, wherein the second drain is coupled to the first gate, the second source is coupled to a ground node and the second gate is coupled to receive a second control signal whereby activation of the second control signal drains the charge from the first gate to the ground node.

8. The circuit according to claim 7 further comprising a third MOSFET having a third drain, a third source and a third drain wherein the third drain is coupled to the first source, the third source is coupled to a ground node and the third gate is coupled to a third control signal.

9. The circuit according to claim 8 wherein the first control signal and the third control signal are alternately activated by the controller whereby the buck current is a square wave having a duty cycle.

10. The circuit according to claim 9 wherein the duty cycle is controllable by the controller.

11. The circuit according to claim 10 wherein the fluorescent lamp circuit comprises an inverter coupled to provide a lamp voltage to a fluorescent lamp wherein a lamp current flows in the lamp in response to the lamp voltage.

12. The circuit according to claim 11 further comprising a circuit for forming a sensing signal representative of the lamp current coupled to deliver the sensing signal to the controller for controlling the duty cycle of the buck current.

13. A circuit for supplying power to a fluorescent lamp comprising:

a. a controller;

b. a buck regulator for forming a buck current signal coupled to be controlled by the controller wherein the buck regulator comprises:

(1) a first MOSFET transistor having a first drain, a first source and a first gate, wherein the first drain is coupled to a supply voltage and the first source forms a buck current signal;

(2) a diode having an anode and a cathode, wherein the cathode is coupled to the first gate;

(3) a second MOSFET having a second drain, a second source, and a second gate, wherein the second drain is coupled to the first gate, the second source is coupled to a ground node and the second gate is coupled to receive a first control signal from the controller; and (4) a transformer having a first winding and a second winding wherein the first winding has a first terminal coupled to receive a second control signal and a second terminal coupled to a low impedance voltage and wherein the second winding has a third terminal coupled to the anode and a fourth terminal coupled to the first source;

(5) a third MOSFET having a third drain, a third source and a third gate wherein the third drain is coupled to the first source, the third source is coupled to the ground node and the third gate is coupled to receive a third control signal;

c. a lamp circuit having a fluorescent lamp, the lamp circuit coupled to receive the buck current signal wherein a lamp current flows in the fluorescent lamp in response to the buck current signal; and d. a sensing circuit coupled to the lamp circuit for forming a sensing signal representative of the lamp current and coupled to deliver the sensing signal to the controller.

14. The circuit according to claim 13 wherein the controller controls a duty-cycle of the buck current signal.

15. The circuit according to claim 14 wherein the duty cycle is controlled in response to the sensing signal.

16. A circuit for supplying power to a fluorescent lamp comprising a buck regulator, wherein the buck regulator comprises:

a. a first NMOS transistor having a first drain, a first source and a first gate, wherein the first drain is coupled to a supply voltage and the first source is coupled to deliver a buck current signal to an inverter circuit;

b. a diode having an anode and a cathode, wherein the cathode is coupled to the first gate;

c. a second transistor having a second drain, a second source, and a second gate, wherein the second drain is coupled to the first gate, the second source is coupled to a ground node and the second gate is coupled to receive a first control signal a controller; and d. a transformer having a first winding and a second winding wherein the first winding has a first terminal coupled to a control output and a second terminal coupled to a low impedance voltage and wherein the second winding has a third terminal coupled to the anode and a fourth terminal coupled to the first source.

17. The circuit according to claim 16 further comprising a third MOSFET having a third drain, a third source and a third drain wherein the third drain is coupled to the first source, the third source is coupled to a ground node and the third gate is coupled to a third control signal.

18. The circuit according to claim 17 wherein the first control signal and the third control signal are alternately activated by the controller whereby the buck current is a square wave having a duty cycle.

19. The circuit according to claim 18 wherein the controller controls a duty cycle of the buck regulator.

20. The circuit according to claim 19 further comprising a sensing circuit coupled to form a sensing signal representative of a current in a fluorescent lamp and coupled to deliver the sensing signal to the controller for controlling the duty cycle of the buck regulator.

* * * * *

UNITED STATES PATENT AND TRADEMARK OFFICE

CERTIFICATE OF CORRECTION

PATENT NO. : 5,844,378

DATED : Dec. 1, 1998

INVENTOR(S) : James J. LoCascio, *et al.*

It is certified that error appears in the above-identified patent and that said Letters Patent is hereby corrected as shown below:

IN THE ABSTRACT

In the title page delete the entire abstract beginning with "A circuit for" to and including "turned on again." and replace with:

--A circuit for supplying power to a fluorescent lamp comprising a buck regulator with a high side drive. A dc battery is coupled to a drain of a first transistor. A source of the first transistor is coupled to an inverter for powering the lamp. A first control signal is coupled to a primary winding of a transformer. A secondary winding of the transformer is coupled to the gate of the first transistor through a diode. The first control signal is activated to bias the first transistor through the transformer by charging the gate to a voltage higher than the control voltage due to the transformer turns ratio. The diode is coupled to capture a charge on the gate. A second transistor is coupled to the gate of the first transistor to drain the captured charge to ground, turning off the first transistor when a second control signal is activated. A third transistor is coupled to ground the source of the first transistor when a third control signal is activated. The lamp brightness is regulated by varying a duty cycle of the buck regulator synchronized to the inverter. The first transistor is turned on when two inverter transistors change state. After a time determined by a lamp current feedback signal, the first transistor is turned off and the third transistor is turned on. The third transistor stays on until the inverter transistors change state again, then the first transistor is turned on again.--

Signed and Sealed this

Eighteenth Day of May, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,844,378

DATED : December 1, 1998

INVENTOR(S) : James J. LoCascio, *et al.*

It is certified that error appears in the above-identified patent and that said Letters Patent is hereby correct as shown below:

On the title page, between item "[76] Inventors:" and item "[21] Appl. No.:", insert the following item:
--[73] Assignee: Micro Linear Corporation, San Jose, Calif.--

Signed and Sealed this

Fifth Day of October, 1999

*Attest:*

Q. TODD DICKINSON

*Attesting Officer*

*Acting Commissioner of Patents and Trademarks*